US010258870B1

(12) United States Patent
Ho et al.

(10) Patent No.: US 10,258,870 B1
(45) Date of Patent: Apr. 16, 2019

(54) MAGNETIC STICKER WITH FOLDING PUZZLE PANELS

(71) Applicants: Chi-Jen Ho, Taipei (TW); Chiu-Wen Lin, Taipei (TW); Chi-Lin Ho, Taipei (TW)

(72) Inventors: Chi-Jen Ho, Taipei (TW); Chiu-Wen Lin, Taipei (TW); Chi-Lin Ho, Taipei (TW)

(73) Assignee: Jie Long Life Co., Ltd, Taipei (TW)

( * ) Notice: Subject to any disclaimer, the term of this patent is extended or adjusted under 35 U.S.C. 154(b) by 506 days.

(21) Appl. No.: 15/081,918

(22) Filed: Mar. 27, 2016

(30) Foreign Application Priority Data

Mar. 30, 2015 (TW) ..... 104204740 U

(51) Int. Cl.
*A63F 9/08* (2006.01)

(52) U.S. Cl.
CPC ..... *A63F 9/08* (2013.01)

(58) Field of Classification Search
CPC ..... A63F 9/08; A63F 9/088
USPC ..... 273/155
See application file for complete search history.

(56) References Cited

U.S. PATENT DOCUMENTS 3,659,360 A * 5/1972 Zeischegg ..... G09B 23/04 273/155
5,651,715 A * 7/1997 Shedelbower ..... A63F 9/088 273/155
6,264,199 B1 * 7/2001 Schaedel ..... A63F 9/088 273/155
6,637,138 B2 * 10/2003 Prost ..... A63F 9/088 273/155
6,712,358 B1 * 3/2004 Dimitriou ..... A63F 9/088 273/156
7,341,251 B1 * 3/2008 Page ..... A63F 9/088 273/155
7,469,495 B2 * 12/2008 Konieczny ..... G09F 1/06 273/155
7,819,403 B2 * 10/2010 Andre ..... G09F 1/04 273/155
8,096,467 B2 * 1/2012 Clegg ..... A63F 9/088 235/380
2011/0169219 A1 * 7/2011 Andre ..... A63F 9/088 273/153 S

* cited by examiner

*Primary Examiner* — Steven B Wong

(57) ABSTRACT

A magnetic sticker with folding puzzle panel, comprising a left front L-shaped panel assembly, a right front L-shaped panel assembly, a left rear L-shaped panel assembly, a right rear L-shaped panel assembly, a left upper panel, a right upper panel, a front lower panel, a rear lower panel, a first upper sticker, a second upper sticker, a plurality of inner stickers, a first lower sticker, a second lower sticker, and at least two magnets, so that the magnetic sticker with folding puzzle panel not only can be attached on fridges or other metallic surfaces, but also can be folded into different shapes to show a variety of images, colors, or photos.

7 Claims, 15 Drawing Sheets

MAGNETIC STICKER WITH FOLDING PUZZLE PANELS

FIELD OF THE INVENTION

The present invention relates to a combination of a magnetic sticker and folding puzzle panels that can be folded into different shapes with different images, colors, or photos.

BACKGROUND OF THE INVENTION

The folding puzzle is a toy that has some numbers or colors painted on panels in irregular order thereof, consumers can fold or flip the puzzle to make the numbers or colors in regular order, which can boost the brainpower, and have more fun. But the most folding puzzle are not applied in other purpose, so that the function of the folding puzzle is single.

The present invention provides a magnetic sticker with folding puzzle panels that is not only can be attached on the fridge or other metallic surfaces, but also can be folded into different shapes to show a variety of images, colors, or photos, which is not only interesting and entertaining effect but also useful.

SUMMARY OF INVENTION

The present invention provide a magnetic sticker with folding puzzle panels that can be made in different shapes, such as a rectangle, a circle, or other polygon. The magnetic sticker with folding puzzle can be folded into different shapes with different images, the structure is simple, interesting, and practical. The technical scheme is that a magnetic sticker with folding puzzle panels (100), comprising: a left front L-shaped panel assembly (10), a right front L-shaped panel assembly (11), a left rear L-shaped panel assembly (11'), a right rear L-shaped panel assembly (10'), a left upper panel (12), a right upper panel (12'), a front lower panel (13), a rear lower panel (13'), a first upper sticker (20), a second upper sticker (20'), a plurality of inner stickers (21), a first lower sticker (22), a second lower sticker (22'), and at least two magnets (14); wherein the left front L-shaped panel assembly (10), the right front L-shaped panel assembly (11), the left rear L-shaped panel assembly (11'), and the right rear L-shaped panel assembly (10') are composed of a horizontal upper panel (a) and a vertical lower panel (b), one end of the vertical lower panel (b) being overlapped and connected with a bottom surface of one end of the horizontal upper panel (a); wherein the left upper panel (12) is arranged between the horizontal upper panel (a) of the left front L-shaped panel assembly (10) and that of the left rear L-shaped panel assembly (11'); the right upper panel (12') is arranged between the horizontal upper panel (a) of the right front L-shaped panel assembly (11) and that of the right rear L-shaped panel assembly (10'); the front lower panel (13) is arranged between the vertical lower panel (b) of the left front L-shaped panel assembly (10) and that of the right front L-shaped panel assembly (11); the rear lower panel (13') is arranged between the vertical lower panel (b) of the left rear L-shaped panel assembly (11') and that of the right rear L-shaped panel assembly (10'); wherein the first upper sticker (20) and the second upper sticker (20') are respectively covered on an upper surface of the magnetic sticker with folding puzzle panels (100); the first lower sticker (22) and the second lower sticker (22') are respectively covered on a bottom surface of the magnetic sticker with folding puzzle panels (100); the inner stickers (21) are covered on inner surfaces of the panel assembles adjacent to each other; wherein the magnets (14) are embedded in the front lower panel (13) and the rear lower panel (13').

Wherein the first upper sticker (20) covers the horizontal upper panel (a) of the left front L-shaped panel assembly (10), the upper panel (12), and the horizontal upper panel (a) of the left rear L-shaped panel assembly (11'); the second upper sticker (20') covers the horizontal upper panel (a) of the right front L-shaped panel assembly (11), the right upper panel (12'), and the horizontal upper panel (a) of the right rear L-shaped panel assembly (10').

Wherein the first lower sticker (22) covers the vertical lower panel (b) of the left front L-shaped panel assembly (10), the front lower panel (13), and the vertical lower panel (b) of the right front L-shaped panel assembly (11); the second lower sticker (22') covers the vertical lower panel (b) of the left rear L-shaped panel assembly (11'), the rear lower panel (13'), and the vertical lower panel (b) of the right rear L-shaped panel assembly (10').

Wherein the magnetic sicker with folding puzzle panels (100) can be one of following configurations: a rectangle, a square, a polygon, a circle; the left front L-shaped panel assembly (10), the right front L-shaped panel assembly (11), the left rear L-shaped panel assembly (11'), the right rear L-shaped panel assembly (10'), the left upper panel (12), the right upper panel (12'), the front lower panel (13), and the rear lower panel (13') having an outer edge (30) configured to form the outer edge of the polygon or the circle in accordance with the configuration of the magnetic sticker with folding puzzle panels (100).

Wherein the left front L-shaped panel assembly (10), the right front L-shaped panel assembly (11), the left rear L-shaped panel assembly (11'), the right rear L-shaped panel assembly (10'), the left upper panel (12), the right upper panel (12'), the front lower panel (13), and the rear lower panel (13') are made of one of the following materials: paper, plastic, metal, wood, acrylic.

wherein the first upper sticker (20), the second upper sticker (20'), the inner stickers (21), the first lower sticker (22), and the second lower sticker (22') are made of adhesive tape (15).

Wherein the adhesive tape (15) is transparent, and printed an image on an outer surface thereof by one of the following processes: hot transfer printing, 3D mapping, laser printing, in-jet printing. The magnetic sticker with folding puzzle panels (100) is not only can be attached on the fridge or other metallic surfaces, but also can be folded into different shapes to show a variety of images, colors, or photos, which is not only interesting and entertaining effect but also useful.

DETAILED DESCRIPTION OF THE PREFERRED EMBODIMENTS

Figure 1:
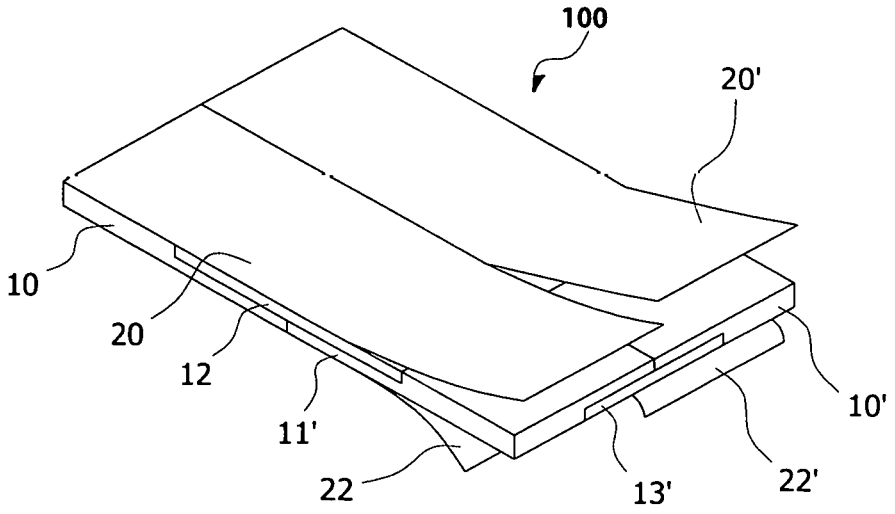
FIG. 1 is a schematic view of a first preferred embodiment of the present invention.
Figure 2:
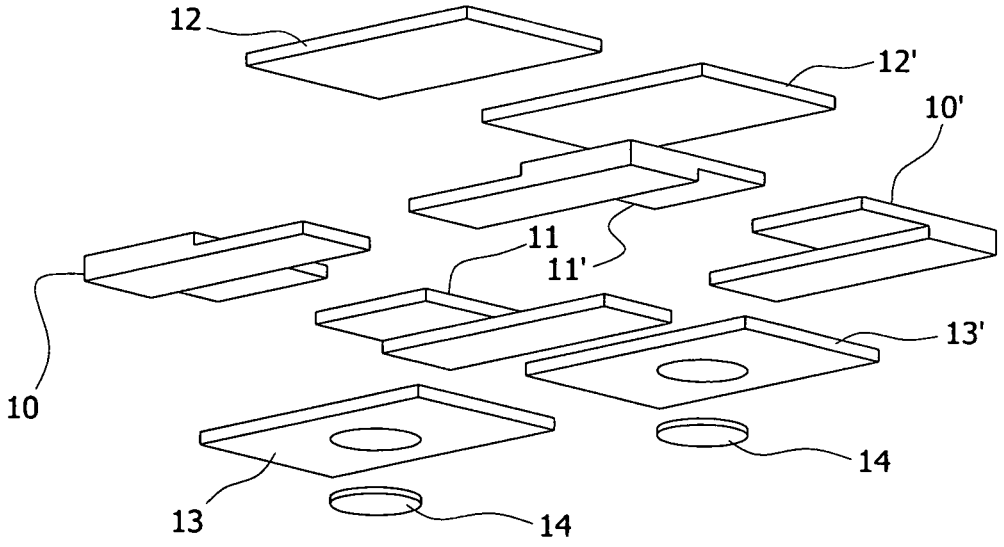
FIG. 2 is an exploded view thereof.
Figure 3:
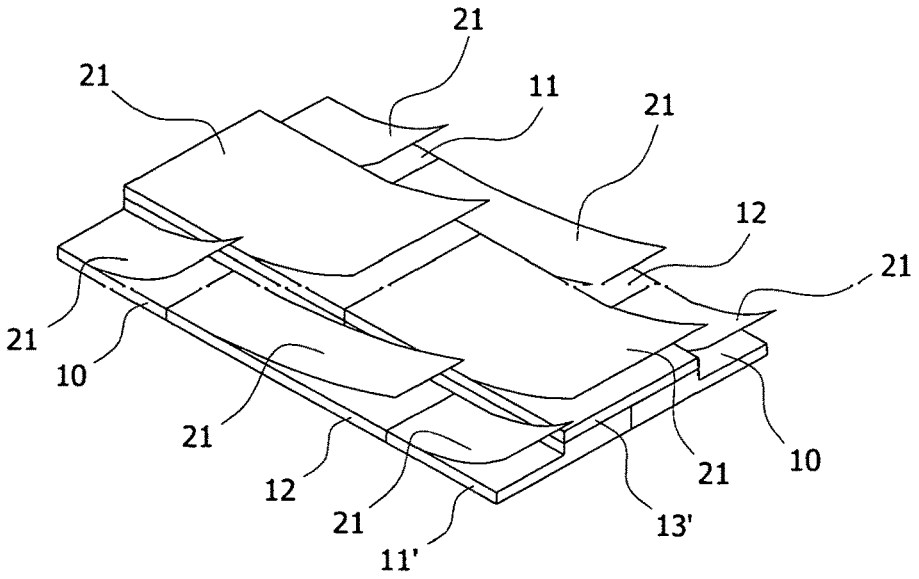
FIG. 3 is another schematic view of the first preferred embodiment of the present invention.
Figure 4:
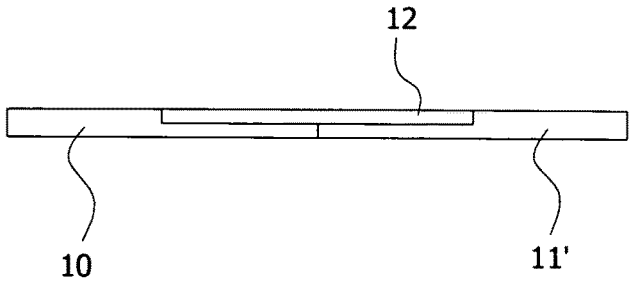
FIG. 4 is a side elevational view thereof.
Figure 5:
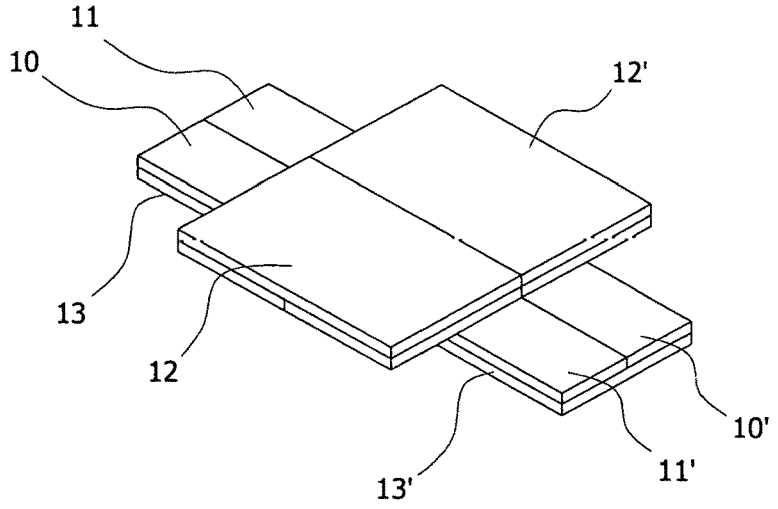
FIG. 5 is a schematic view showing a magnetic sticker with folding puzzle panels of the first preferred embodiment in use.
Figure 6:
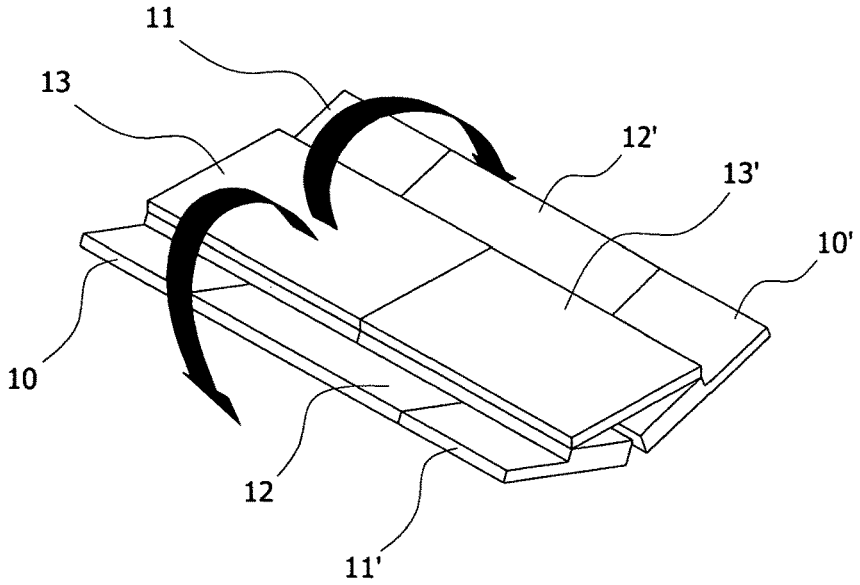
FIG. 6 is another schematic view showing the magnetic sticker with folding puzzle panels of the first preferred embodiment in use.

Implementations of the present invention include third preferred embodiments, in which the components corresponding to one another in the embodiments will be given the same reference numerals.

Referring to FIG. 1-6, the present invention provides a magnetic sticker with folding puzzle panels (100) in a rectangle shape of a first preferred embodiment, comprising: a left front L-shaped panel assembly (10), a right front L-shaped panel assembly (11), a left rear L-shaped panel assembly (11'), a right rear L-shaped panel assembly (10'), a left upper panel (12), a right upper panel (12'), a front lower panel (13), a rear lower panel (13'), a first upper sticker (20), a second upper sticker (20'), a plurality of inner stickers (2), a first lower sticker (22), a second lower sticker (22'), and at least two magnets (14);

wherein the left front L-shaped panel assembly (10), the right front L-shaped panel assembly (11), the left rear L-shaped panel assembly (11'), and the right rear L-shaped panel assembly (10') are composed of a horizontal upper panel (a) and a vertical lower panel (b), one end of the vertical lower panel (b) being overlapped and connected with a bottom surface of one end of the horizontal upper panel (a);

wherein the left upper panel (12) is arranged between the horizontal upper panel (a) of the left front L-shaped panel assembly (10) and that of the left rear L-shaped panel assembly (11'); the right upper panel (12') is arranged between the horizontal upper panel (a) of the right front L-shaped panel assembly (11) and that of the right rear L-shaped panel assembly (10'); the front lower panel (13) is arranged between the vertical lower panel (b) of the left front L-shaped panel assembly (10) and that of the right front L-shaped panel assembly (11); the rear lower panel (13') is arranged between the vertical lower panel (b) of the left rear L-shaped panel assembly (11') and that of the right rear L-shaped panel assembly (10');

wherein the first upper sticker (20) and the second upper sticker (20') are respectively covered on an upper surface of the magnetic sticker with folding puzzle panels (100); the first lower sticker (22) and the second lower sticker (22') are respectively covered on a bottom surface of the magnetic sticker with folding puzzle panels (100); the inner stickers (21) are covered on inner surfaces of the panel assembles adjacent to each other;

wherein the magnets (14) are embedded in the front lower panel (13) and the rear lower panel (13').

The magnetic sticker with folding puzzle panels (100) can be folded to an irregular shape, and then back to the original shape. The first upper sticker (20), the second upper sticker (20'), the inner stickers (21), the first lower sticker (22), and the second lower sticker (22') are covered on the top surface and the bottom surface of the magnetic sticker with folding sticker (100) and painted with different images or photos thereon, every panel of the magnetic sticker is folded in a specific position according to the shape of the panel and the sticker attached thereon, when the magnetic sticker with folding puzzle panels (100) is folded into different shapes, the images or the photos painted thereon will also be changed. Therefore, when the magnetic sticker with folding puzzle panels (100) of the present invention is in use (for fridge and other metallic surfaces), the magnetic sticker can be changed into different shape and images by folding panels thereof, depending on your preferences. The magnetic sticker with folding puzzle panels (100) of the present invention can be changed into three different shapes with four different images or photos.

Wherein the first upper sticker (20) covers the horizontal upper panel (a) of the left front L-shaped panel assembly (10), the upper panel (12), and the horizontal upper panel (a) of the left rear L-shaped panel assembly (11'); the second upper sticker (20') covers the horizontal upper panel (a) of the right front L-shaped panel assembly (11), the right upper panel (12'), and the horizontal upper panel (a) of the right rear L-shaped panel assembly (10').

Wherein the left front L-shaped panel assembly (10), the right front L-shaped panel assembly (11), the left rear L-shaped panel assembly (11'), the right rear L-shaped panel assembly (10'), the left upper panel (12), the right upper panel (12'), the front lower panel (13), and the rear lower panel (13') are made of one of the following materials: paper, plastic, metal, wood, acrylic.

Figure 7:
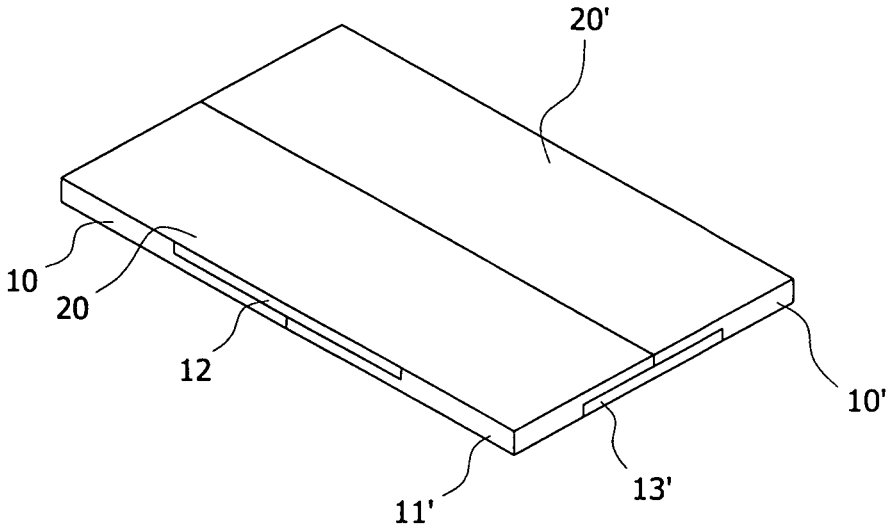
FIG. 7 is another schematic view thereof.
Figure 8:
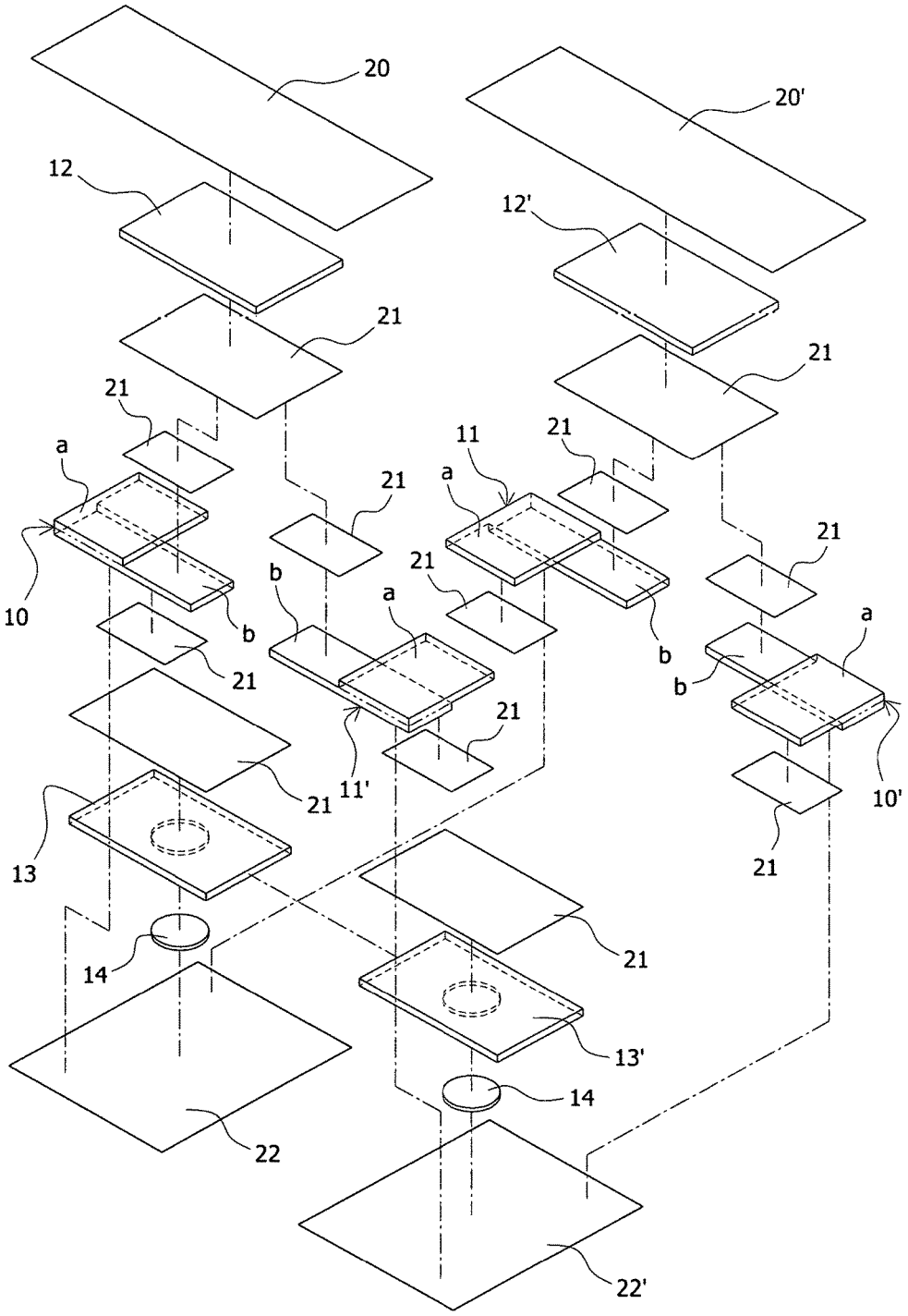
FIG. 8 is another exploded view thereof.
Figure 9:
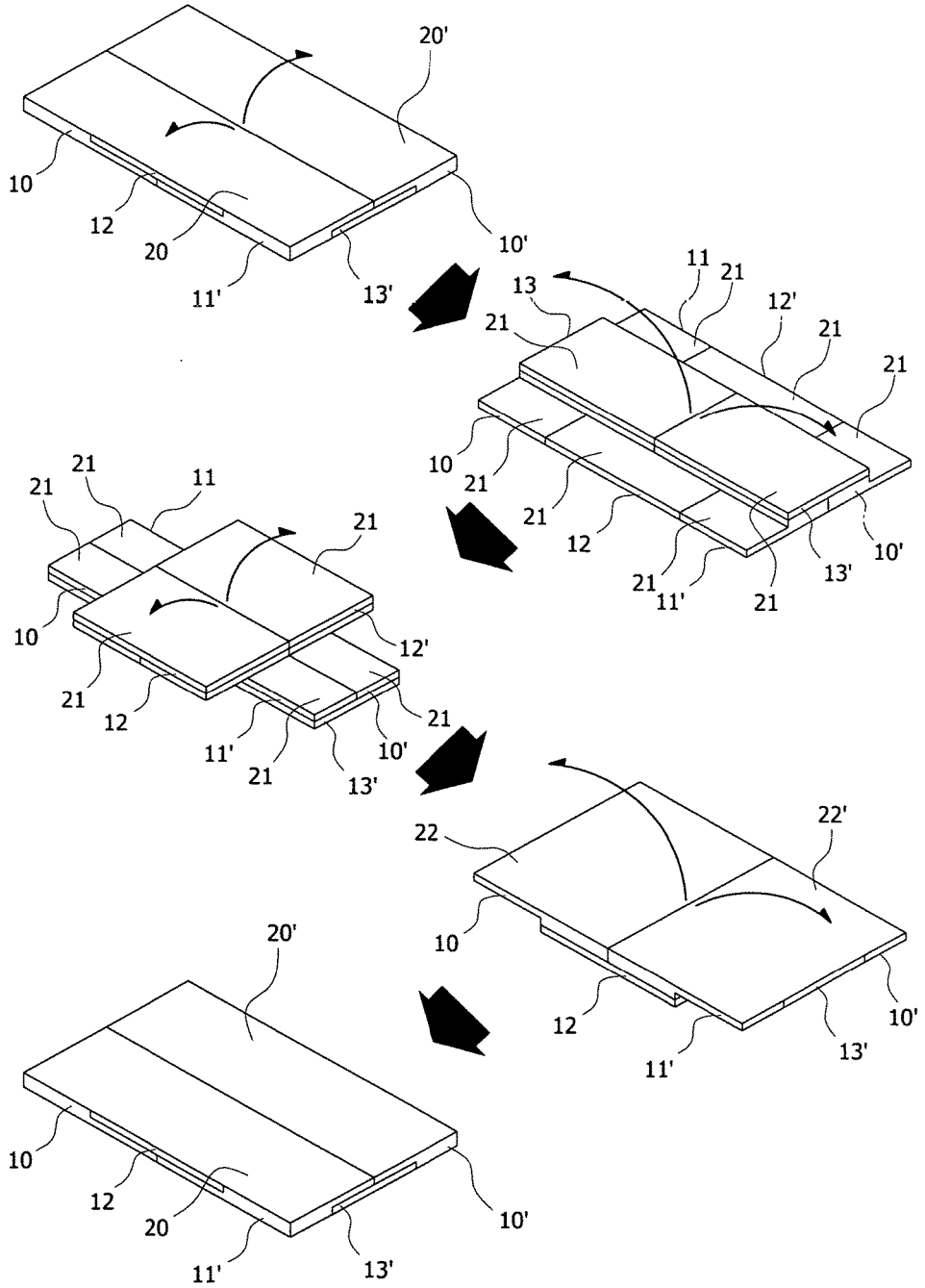
FIG. 9 is another schematic view showing the magnetic sticker with folding puzzle panels of the first preferred embodiment in use.

Referring to FIG. 7-9, wherein the first lower sticker (22) covers the vertical lower panel (b) of the left front L-shaped panel assembly (10), the front lower panel (13), and the vertical lower panel (b) of the right front L-shaped panel assembly (11); the second lower sticker (22') covers the vertical lower panel (b) of the left rear L-shaped panel assembly (11'), the rear lower panel (13'), and the vertical lower panel (b) of the right rear L-shaped panel assembly (10').

Figure 10:
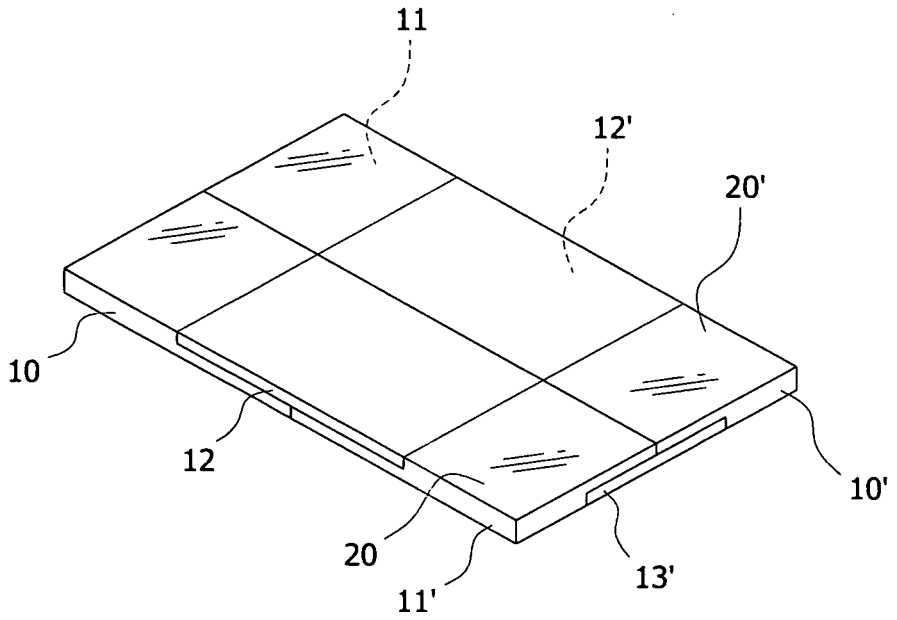
FIG. 10 is another schematic view thereof.
Figure 11:
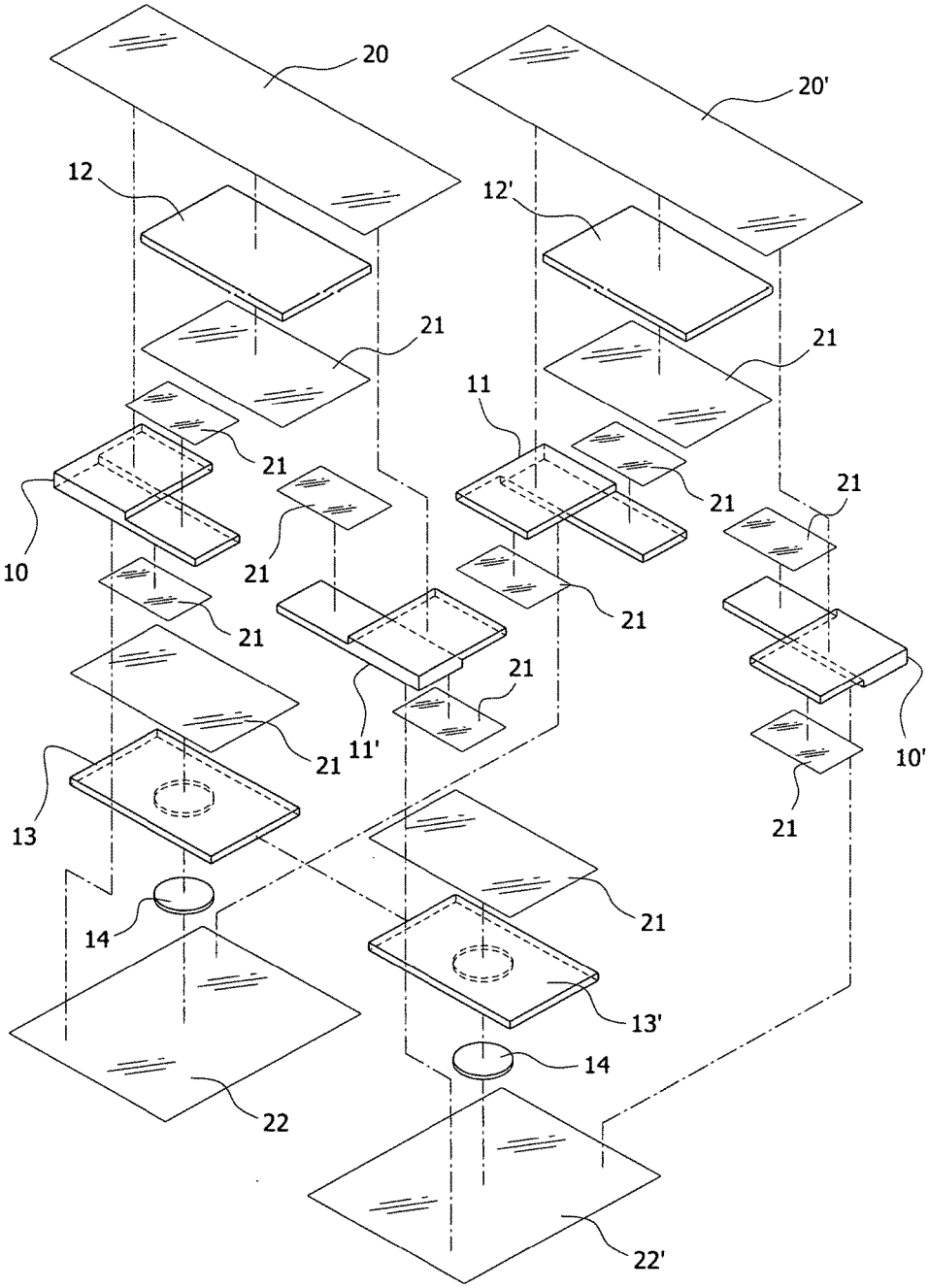
FIG. 11 is another schematic view thereof.
Figure 12:
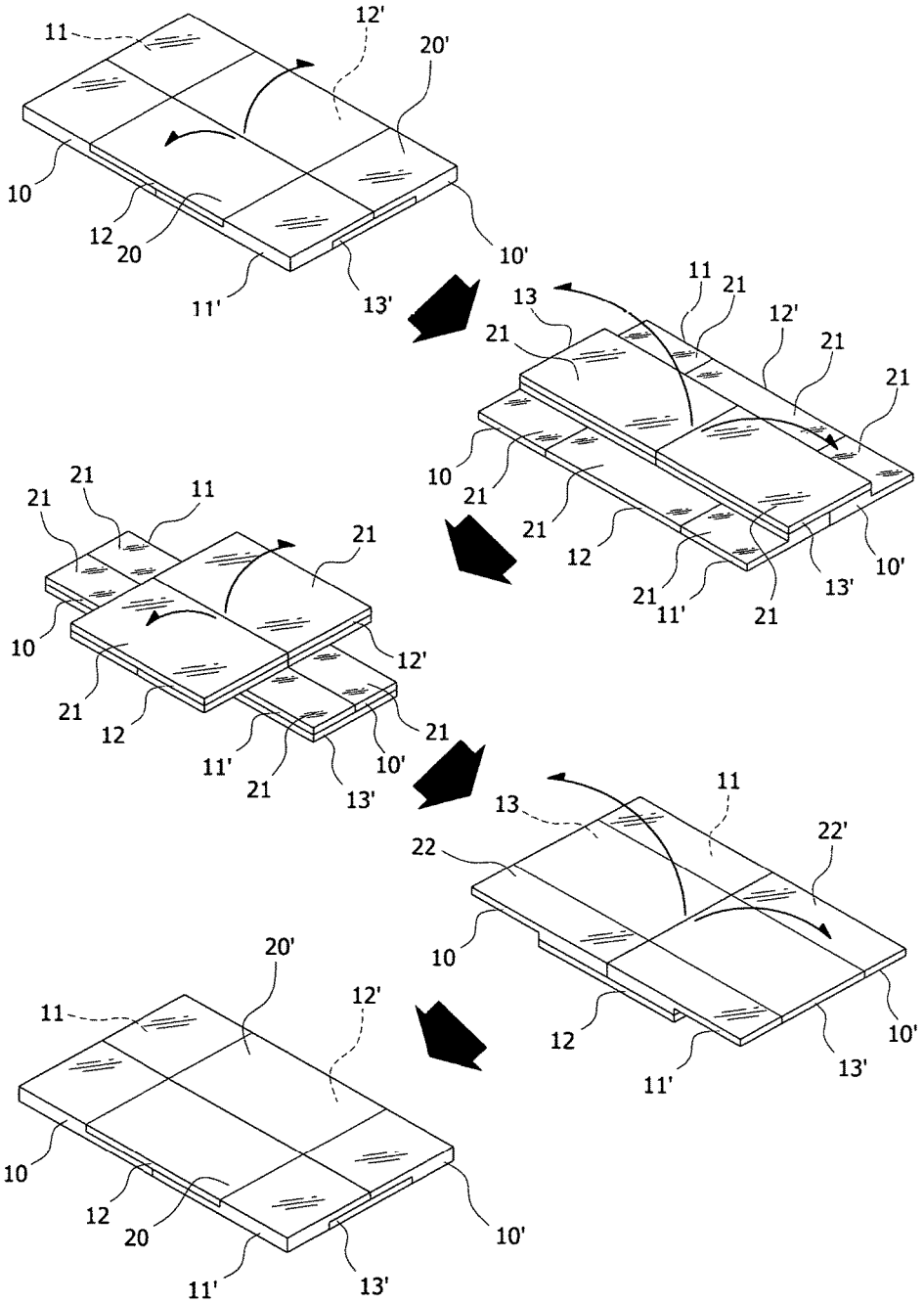
FIG. 12 is another schematic view showing the magnetic sticker with folding puzzle panels of the first preferred embodiment in use.
Figure 13:
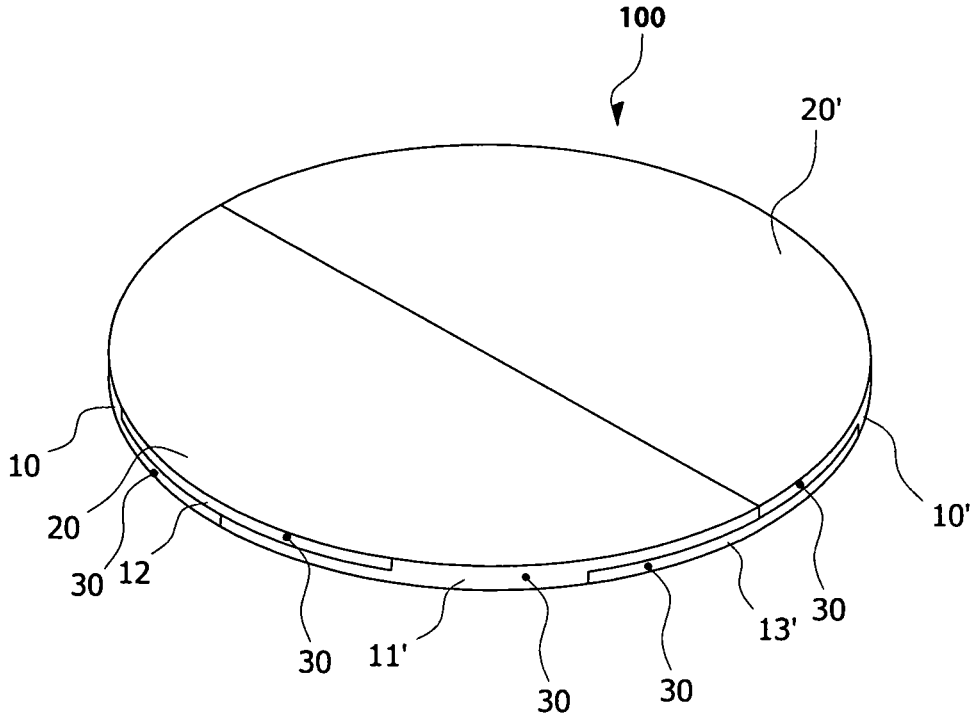
FIG. 13 is a schematic view of a second preferred embodiment of the present invention.
Figure 14:
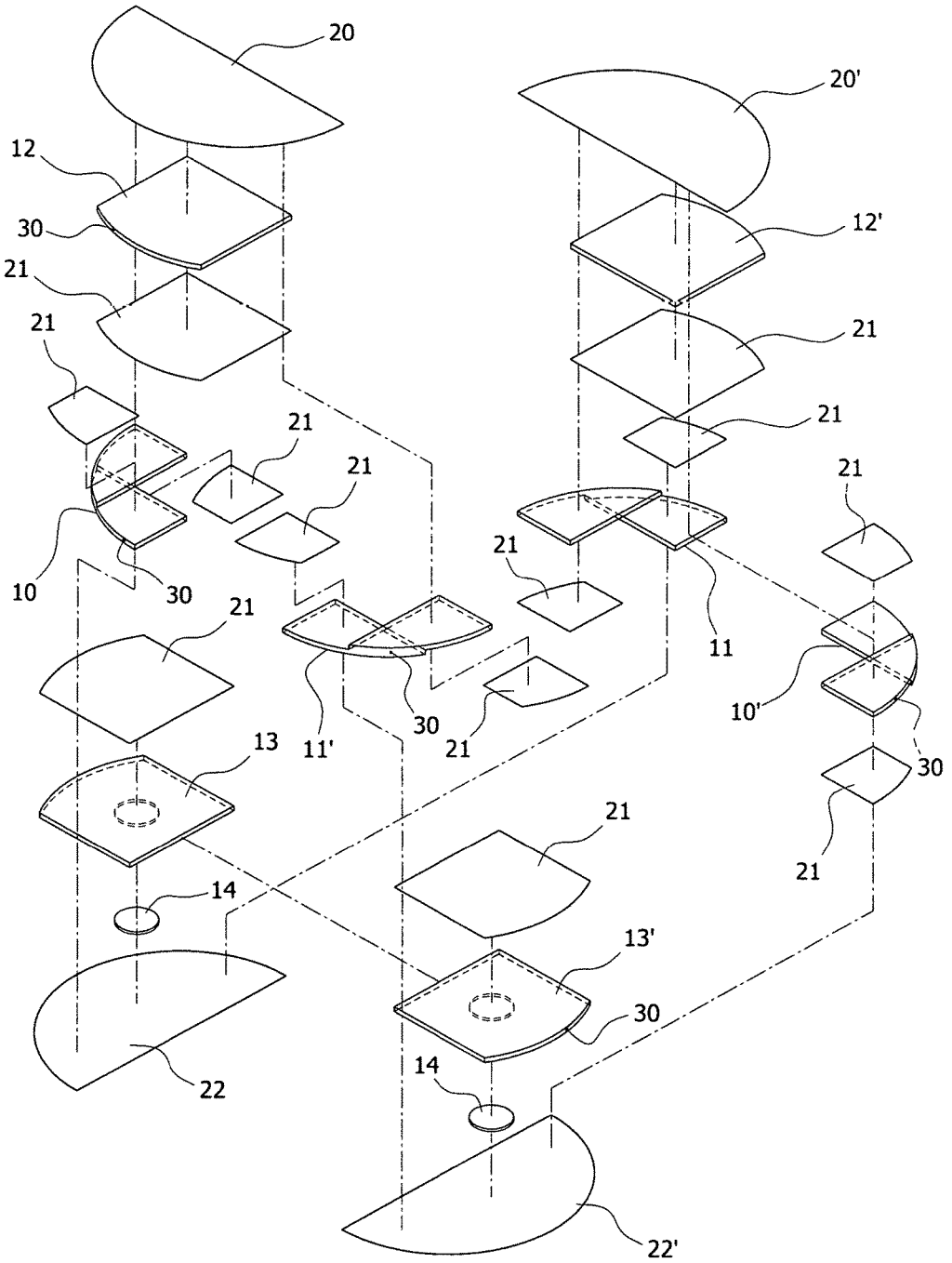
FIG. 14 is an exploded view of the second preferred embodiment of the present invention.
Figure 15:
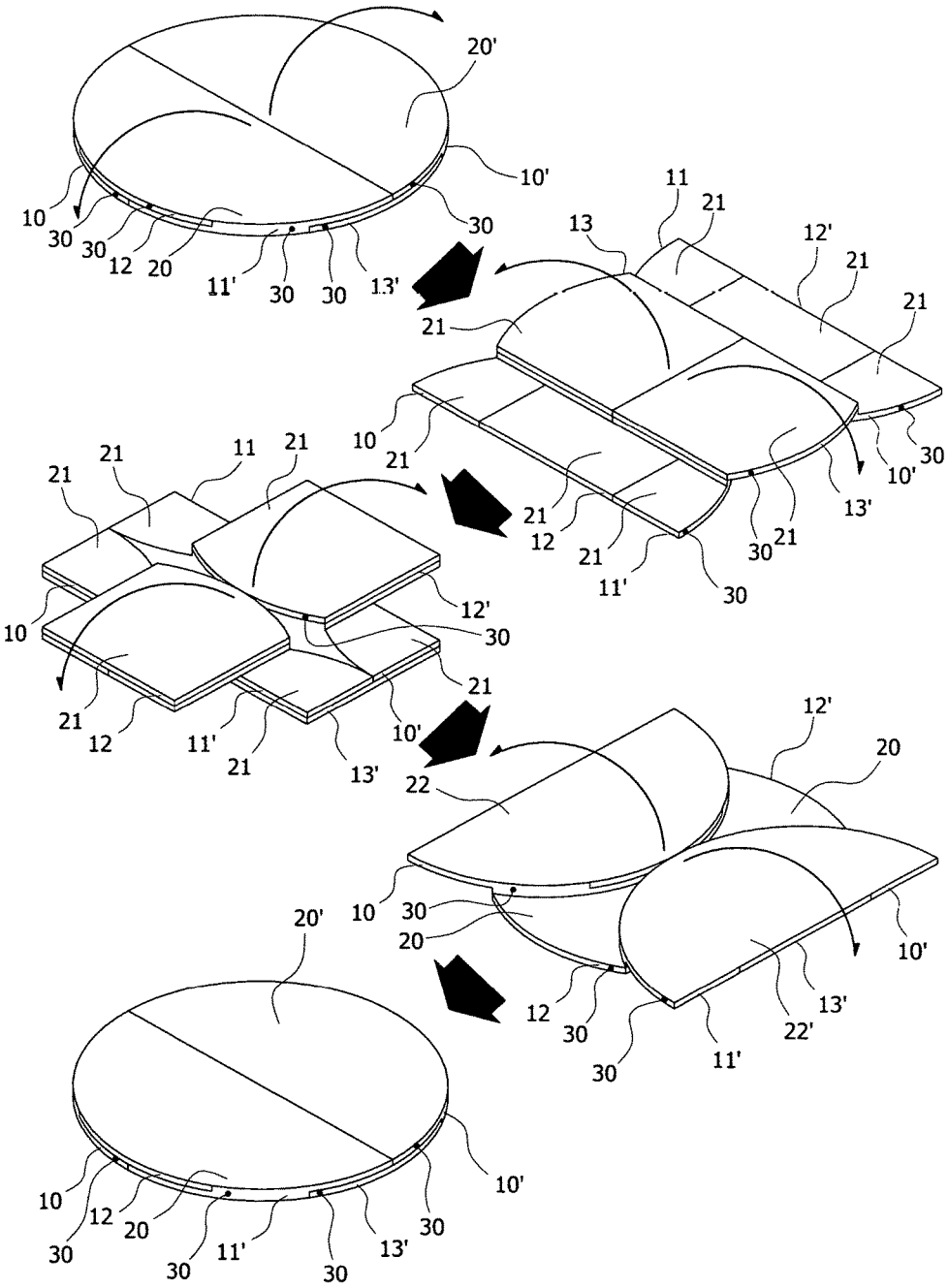
FIG. 15 is a schematic view showing a magnetic sticker with folding puzzle panels of the second preferred embodiment in use.
Figure 16:
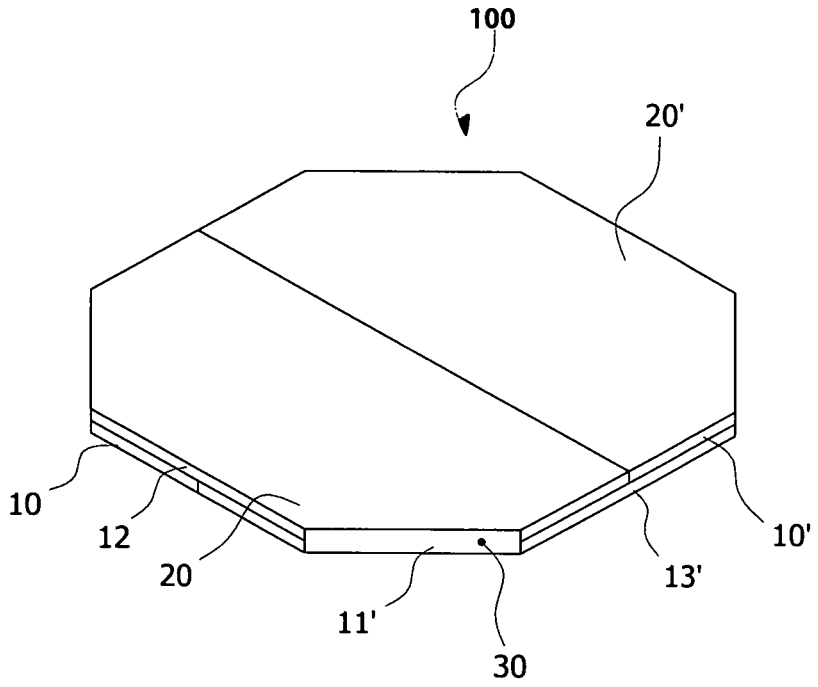
FIG. 16 is a schematic view of a third preferred embodiment of the present invention.
Figure 17:
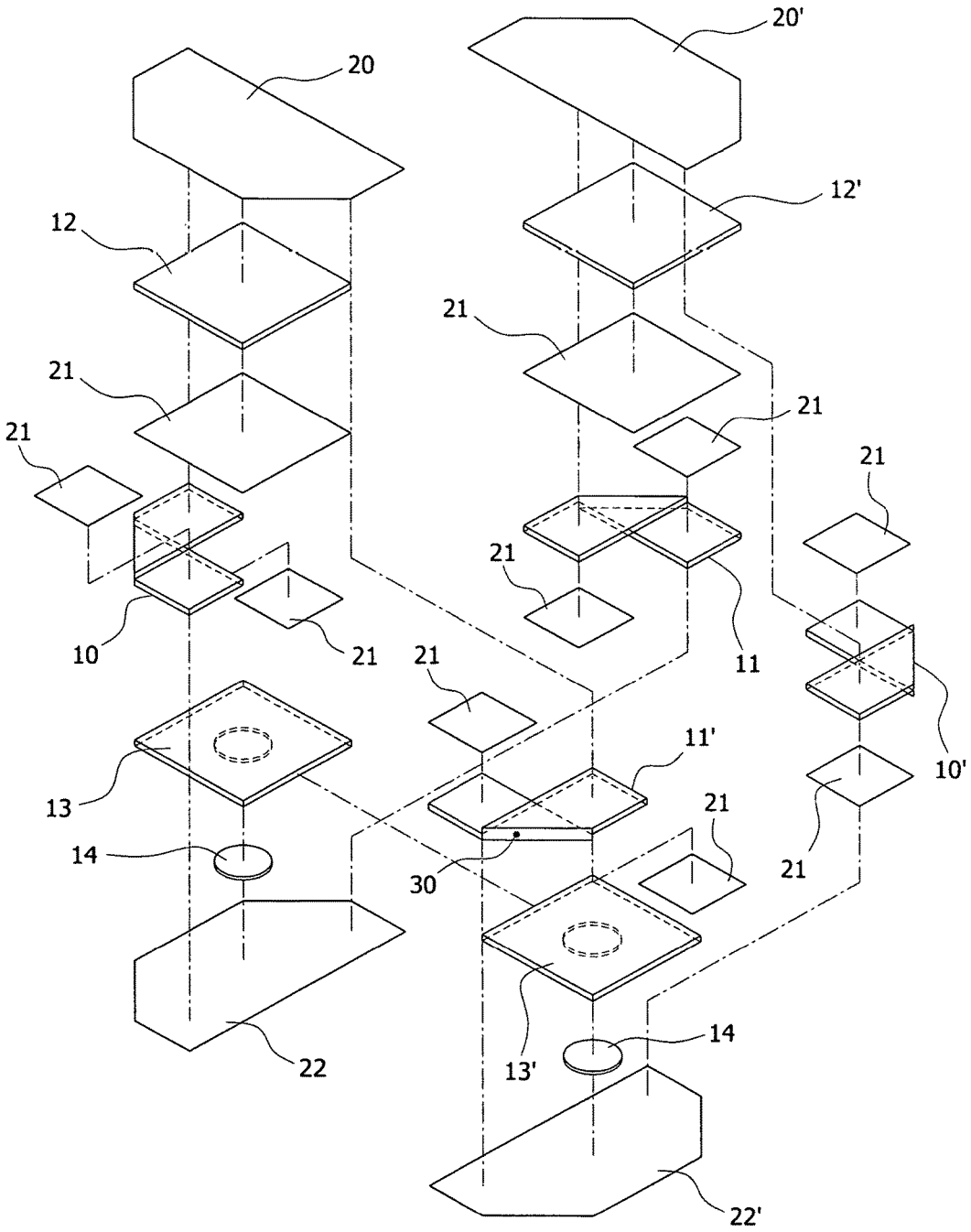
FIG. 17 is an exploded view of the third preferred embodiment of the present invention; and, FIG. 18 is a schematic view showing a magnetic sticker with folding puzzle panels of the third preferred embodiment in use.
Figure 18:
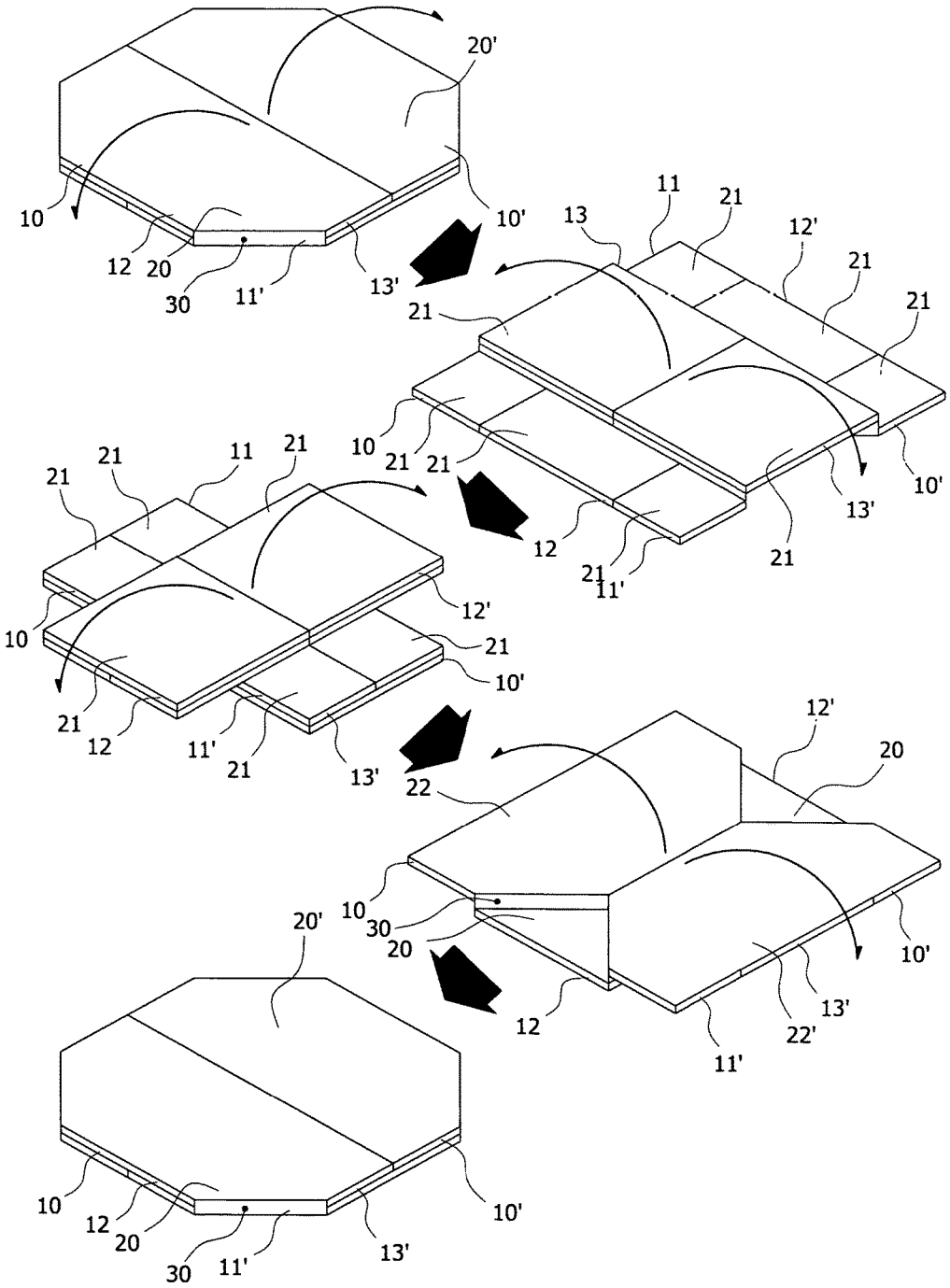

Referring to FIG. 10-12, wherein the first upper sticker (20), the second upper sticker (20'), the inner stickers (21), the first lower sticker (22), and the second lower sticker (22') of the magnetic sticker with folding puzzle panels (100) are made of adhesive tape (15).

Wherein the adhesive tape (15) is transparent, and printed an image on an outer surface thereof by one of the following processes: hot transfer printing, 3D mapping, laser printing, in-jet printing.

Wherein the magnetic sicker with folding puzzle panels (100) can be one of following configurations: a rectangle, a square, a polygon, a circle; the left front L-shaped panel assembly (10), the right front L-shaped panel assembly (11), the left rear L-shaped panel assembly (11'), the right rear L-shaped panel assembly (10'), the left upper panel (12), the right upper panel (12'), the front lower panel (13), and the rear lower panel (13') having an outer edge (30) configured to form the outer edge of the polygon or the circle in accordance with the configuration of the magnetic sticker with folding puzzle panels (100). FIG. 13-15 show a magnetic sticker with folding puzzle panels in a circle shape of a second preferred embodiment; FIG. 16-18 show a magnetic sticker with folding puzzle panels in an octagonal shape of a third preferred embodiment. Except outer edges of the shape, the structures and folding methods of the second and third preferred embodiment are the same as the first embodiment, so that the magnetic sticker with folding puzzle panels (100) is not only can be attached on the fridge or other metallic surfaces, but also can be folded into different shapes to show a variety of images, colors, or photos, which is not only interesting and entertaining effect but also useful.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. A magnetic sticker with folding puzzle panels (100), comprising:

a left front L-shaped panel assembly (10), a right front L-shaped panel assembly (11), a left rear L-shaped panel assembly (11'), a right rear L-shaped panel assembly (10'), a left upper panel (12), a right upper panel (12'), a front lower panel (13), a rear lower panel (13'), a first upper sticker (20), a second upper sticker (20'), a plurality of inner stickers (21), a first lower sticker (22), a second lower sticker (22'), and at least two magnets (14);

wherein the left front L-shaped panel assembly (10), the right front L-shaped panel assembly (11), the left rear L-shaped panel assembly (11'), and the right rear L-shaped panel assembly (10') are composed of a horizontal upper panel (a) and a vertical lower panel (b), one end of the vertical lower panel (b) being overlapped and connected with a bottom surface of one end of the horizontal upper panel (a);

wherein the left upper panel (12) is arranged between the horizontal upper panel (a) of the left front L-shaped panel assembly (10) and that of the left rear L-shaped panel assembly (11'); the right upper panel (12') is arranged between the horizontal upper panel (a) of the right front L-shaped panel assembly (11) and that of the right rear L-shaped panel assembly (10'); the front lower panel (13) is arranged between the vertical lower panel (b) of the left front L-shaped panel assembly (10) and that of the right front L-shaped panel assembly (11); the rear lower panel assembly (13') is arranged between the vertical lower panel (b) of the left rear L-shaped panel assembly (11') and that of the right rear L-shaped panel assembly (10');

wherein the first upper sticker (20) and the second upper sticker (20') are respectively covered on an upper surface of the magnetic sticker with folding puzzle panels (100); the first lower sticker (22) and the second lower sticker (22') are respectively covered on a bottom surface of the magnetic sticker with folding puzzle panels (100); the inner stickers (21) are covered on inner surfaces of the panel assembles adjacent to each other;

wherein the magnets (14) are embedded in the front lower panel (13) and the rear lower panel (13').

2. The magnetic sticker with folding puzzle panel according to claim 1, wherein the first upper sticker (20) covers the horizontal upper panel (a) of the left front L-shaped panel assembly (10), the upper panel (12), and the horizontal upper panel (a) of the left rear L-shaped panel assembly (11'); the second upper sticker (20') covers the horizontal upper panel (a) of the right front L-shaped panel assembly (11), the right upper panel (12'), and the horizontal upper panel (a) of the right rear L-shaped panel assembly (10').

3. The magnetic sticker with folding puzzle panel according to claim 1, wherein the first lower sticker (22) covers the vertical lower panel (b) of the left front L-shaped panel assembly (10), the front lower panel (13), and the vertical lower panel (b) of the right front L-shaped panel assembly (11); the second lower sticker (22') covers the vertical lower panel (b) of the left rear L-shaped panel assembly (11'), the rear lower panel (13'), and the vertical lower panel (b) of the right rear L-shaped panel assembly (10').

4. The magnetic sticker with folding puzzle panel according to claim 1, wherein the magnetic sicker with folding puzzle panels (100) can be one of following configurations: a rectangle, a square, a polygon, a circle; the left front L-shaped panel assembly (10), the right front L-shaped panel assembly (11), the left rear L-shaped panel assembly (11'), the right rear L-shaped panel assembly (10'), the left upper panel (12), the right upper panel (12'), the front lower panel (13), and the rear lower panel (13') having an outer edge (30) configured to form the outer edge of the polygon or the circle in accordance with the configuration of the magnetic sticker with folding puzzle panels (100).

5. The magnetic sticker with folding puzzle panel according to claim 1, wherein the left front L-shaped panel assembly (10), the right front L-shaped panel assembly (11), the left rear L-shaped panel assembly (11'), the right rear L-shaped panel assembly (10'), the left upper panel (12), the right upper panel (12'), the front lower panel (13), and the rear lower panel (13') are made of one of the following materials: paper, plastic, metal, wood, acrylic.

6. A magnetic sticker with folding puzzle panels (100), comprising:

a left front L-shaped panel assembly (10), a right front L-shaped panel assembly (11), a left rear L-shaped panel assembly (11'), a right rear L-shaped panel assembly (10'), a left upper panel (12), a right upper panel (12'), a front lower panel (13), a rear lower panel (13'), a first upper sticker (20), a second upper sticker (20'), a plurality of inner stickers (21), a first lower sticker (22), a second lower sticker (22'), and at least two magnets (14);

wherein the left front L-shaped panel assembly (10), the right front L-shaped panel assembly (11), the left rear L-shaped panel assembly (11'), and the right rear L-shaped panel assembly (10') are composed of a horizontal upper panel (a) and a vertical lower panel (b), one end of the vertical lower panel (b) being overlapped and connected with a bottom surface of one end of the horizontal upper panel (a);

wherein the left upper panel (12) is arranged between the horizontal upper panel (a) of the left front L-shaped panel assembly (10) and that of the left rear L-shaped panel assembly (11'); the right upper panel (12') is arranged between the horizontal upper panel (a) of the right front L-shaped panel assembly (11) and that of the right rear L-shaped panel assembly (10'); the front lower panel (13) is arranged between the vertical lower panel (b) of the left front L-shaped panel assembly (10) and that of the right front L-shaped panel assembly (11); the rear lower panel (13') is arranged between the vertical lower panel (b) of the left rear L-shaped panel assembly (11') and that of the right rear L-shaped panel assembly (10');

wherein the first upper sticker (20) and the second upper sticker (20') respectively covers an upper surface of the magnetic sticker with folding puzzle panels (100); the first lower sticker (22) and the second lower sticker (22') respectively covers a bottom surface of the magnetic sticker with folding puzzle panels (100); the inner stickers (21) cover on inner surfaces of the panel assembles adjacent to each other;

wherein the magnets (14) are embedded in the front lower panel (13) and the rear lower panel (13');

wherein the first upper sticker (20), the second upper sticker (20'), the inner stickers (21), the first lower sticker (22), and the second lower sticker (22') are made of adhesive tape (15).

7. The magnetic sticker with folding puzzle panels (100) according to claim 6, wherein the adhesive tape (15) is transparent, and printed an image on an outer surface thereof by one of the following processes: hot transfer printing, 3D mapping, laser printing, ink-jet printing.

* * * * *